United States Patent [19]

Ahlers

[11] Patent Number: 5,064,339

[45] Date of Patent: Nov. 12, 1991

[54] BACKHOE BOOM LOCK

[75] Inventor: Steven W. Ahlers, Dubuque, Iowa

[73] Assignee: Deere & Company, Moline, Ill.

[21] Appl. No.: 636,657

[22] Filed: Jan. 2, 1991

[51] Int. Cl.[5] ..... C02F 3/32

[52] U.S. Cl. ..... 414/687; 172/481; 212/222; 414/694

[58] Field of Search ..... 414/694, 686, 687, 695-695.8; 212/222, 229; 172/481; 292/213, 214, 230, 235, 238, 246

[56] References Cited

U.S. PATENT DOCUMENTS

| | | | |
|---|---|---|---|
| 1,802,741 | 4/1931 | Stephens | 292/246 |
| 4,225,282 | 9/1980 | Nordstrom et al. | 414/694 |
| 4,260,321 | 4/1981 | Beauchamp et al. | 414/694 |
| 4,273,503 | 6/1981 | Maurer et al. | 414/694 |
| 4,278,394 | 7/1981 | Johnson | 414/694 |
| 4,636,132 | 1/1987 | Menke et al. | 414/694 |
| 4,887,938 | 12/1989 | Menke | 414/694 |

*Primary Examiner*—Robert J. Spar
*Assistant Examiner*—Donald W. Underwood

[57] ABSTRACT

A backhoe loader has a rearward backhole mechanism having a swing frame pivotally connected to a tractor main frame on a pair of vertical pivots. A backhoe boom is swingable on a transverse pivot carried by the swing frame by actuation of a hydraulic cylinder, and the booom being swingable between rearward operating positions and a generally upright transport position. The boom is lockable in its transport position by a mechanism that includes a T-shaped latch member that is swingably mounted on the swing frame on a horizontal pivot, the swinging movement being controlled by a control lever and cable system actuable from the vehicle operator station. The lock includes a pair of upwardly open hook-type lock elements on the boom that respectively receive lock pins formed by the cross portion of the T-shaped latch member, and the hook elements having inclined ramps at their forward ends that engage the latch member pins as the boom swings rearwardly into its transport position to shift the latch member upwardly until the pins clear the ramps and drop downwardly into the sockets of the hook-type elements. An adjustable stop is provided on the swing frame for engaging the boom and limiting the rearward movement of the boom past the upright transport position.

8 Claims, 4 Drawing Sheets

Fig. 3
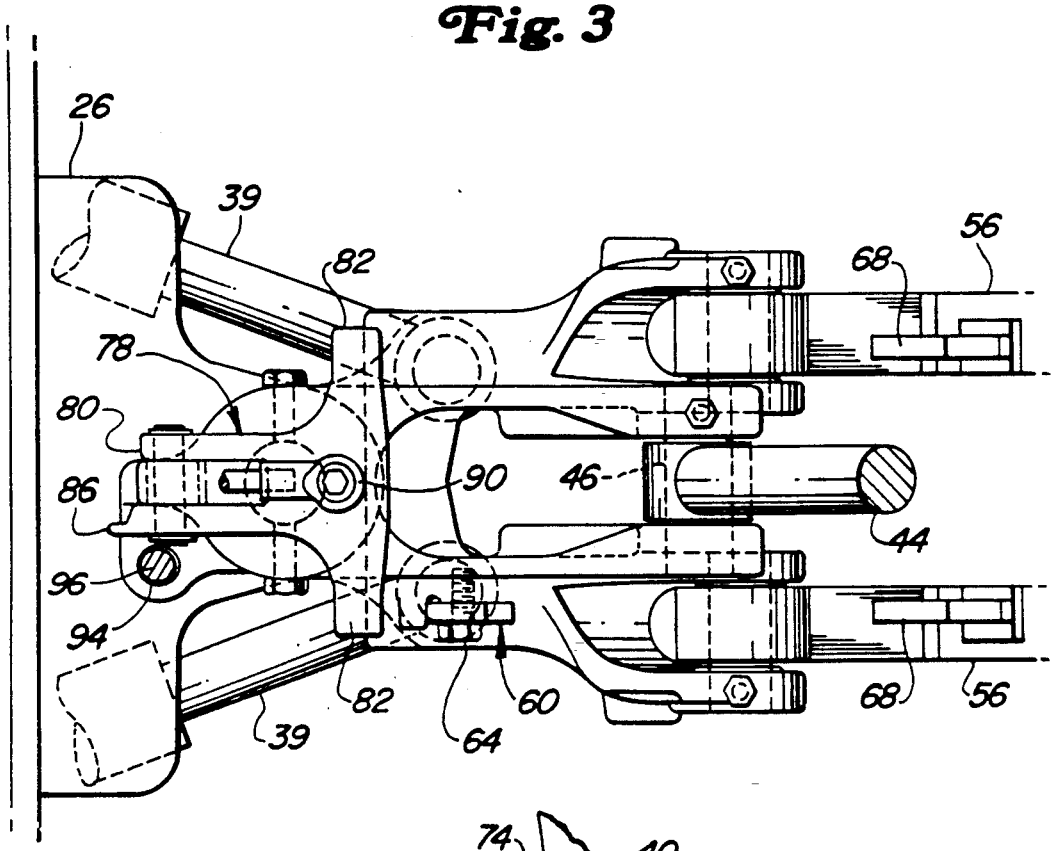
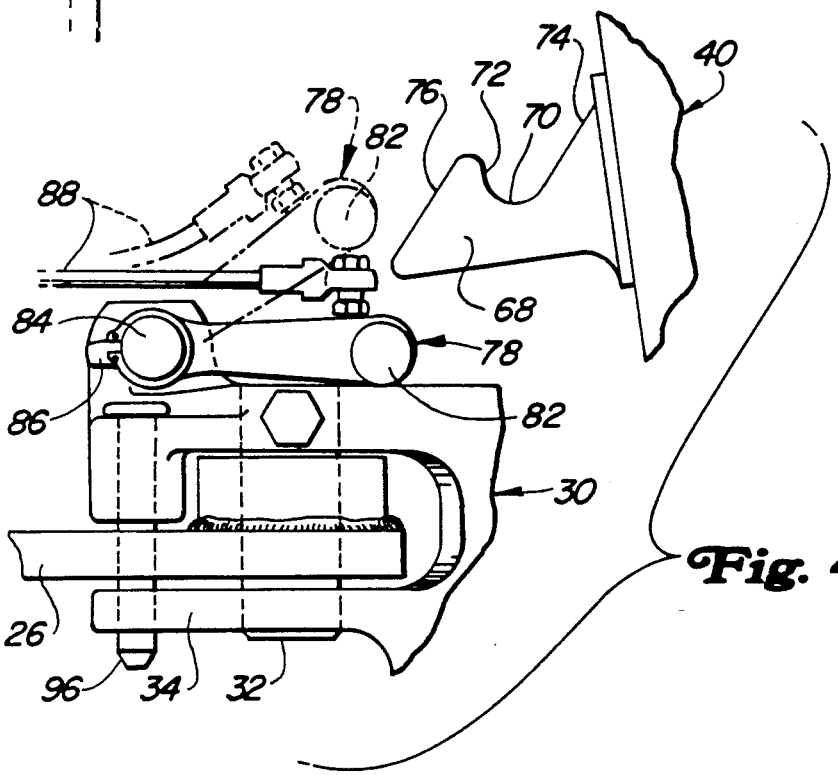
Fig. 4

BACKHOE BOOM LOCK

BACKGROUND OF THE INVENTION

This invention relates to a vehicle mounted backhoe and more particularly to an improved lock mechanism for locking the backhoe boom to the vehicle frame when the vehicle is being transported or when it is desired that the boom be locked in position, such as when the backhoe is functioning as a crane.

A number of devices have previously been known for performing the above function. However, such prior devices have not been entirely satisfactory from a durability, simplicity, functional, or adjustability standpoint.

SUMMARY OF THE INVENTION

According to the present invention, a simple and durable device is provided for releasably locking a backhoe boom to the frame of its supporting vehicle. An important feature of the invention resides in the provision of a simple latching element that is cammed upwardly as the backhoe boom moves into its transport position and then drops into a locking position wherein it engages upwardly open hook-type elements on the backhoe boom after the boom reaches it upright transport position. A feature of the invention resides in the fact that the weight of the boom holds the latch element in its locking position. Also according to the invention, the latch element is controlled from the operator station by a cable so that it can be pulled upwardly to an unlocking condition once the weight of the backhoe boom is taken off of the latching element.

Another feature of the invention resides in the provision of a simple adjustable stop on the swing frame of the backhoe for engaging the backhoe boom to limit the forward motion of the boom beyond its upright transport position. The stop is adjustable to compensate for the wear on the backhoe components.

Also according to the invention, the latching members that are engaged by the hook-type lock elements on the boom to hold the boom in place can be selectively positioned so that they clear the locking elements on the boom, whereby the boom can be moved to its vertical transport position without being locked in place. Alternately, the latch elements can be positioned so that they automatically engage the lock elements on the boom when it is moved to its transport position, so the boom locking mechanism can, at the option of the operator, be automatically engaged when the boom is moved to its transport position.

BRIEF DESCRIPTION OF THE DRAWINGS

FIG. 3 is a plan view of the portion of the backhoe shown in FIG. 2.

FIG. 4 is a side elevation view of the locking mechanism showing the latch element in a non-locking position, but showing the latch element in dotted lines in an alternate position wherein it is engageable with the lock element on the boom.

DESCRIPTION OF THE PREFERRED EMBODIMENT

Figure 1:
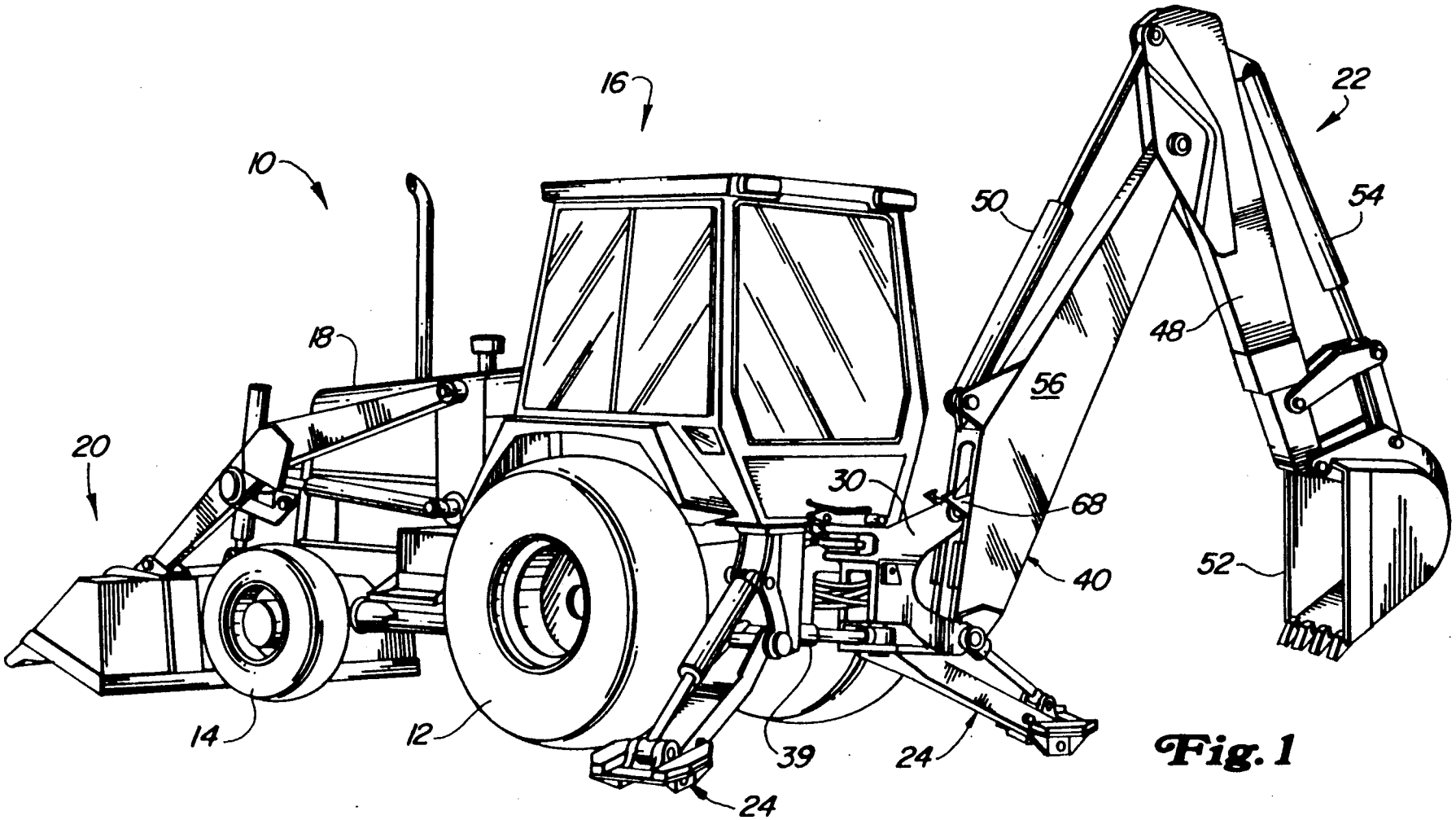
FIG. 1 is a left rear perspective of a backhoe loader embodying the invention.

The invention is embodied in a loader backhoe that conventionally includes a tractor-type support vehicle 10 having a pair of drive wheels 12 and steerable front wheels 14. As is well known, an operator station, indicated generally by the numeral 16, is disposed between the rear wheels, the operator station in the illustrated embodiment including a cab. Forwardly of the operator station is an engine (not shown) covered by a hood 18, and, as is well known, the machine includes a forward loader 20 that is controlled by the operator at the operator station with the operator seat (not shown) facing forward. A backhoe, indicated in its entirety by the numeral 22, is mounted on the rear of the machine, and as is also well known, the operator seat is reversible and the backhoe is operated with the seat facing rearwardly, appropriate controls being provided at the rear of the operator station for controlling the backhoe functions. As is also conventional, a pair of stabilizers 24 are connected to the rear end of the tractor frame and can be actuated to elevate the rear end of the tractor to stabilize the machine when the backhoe is being operated.

As is also well known, the tractor frame includes an upper rearwardly extending generally triangular plate 26 and a similar lower plate 28 that support the backhoe 22. The backhoe includes a swing frame, indicated in its entirety by the numeral 30, and the swing frame is swingably connected to the tractor 10 by an upper vertical pivot 32 that pivotally connects a pair of upper arms 34 on the swing frame to the rear end of the upper plate 26, while a lower pivot 36 co-axial with the upper pivot 32 pivotally connects a pair of lower swing frame arms 38 to the rear end of the lower plate 28. A pair of swing cylinders 39 extend between the tractor and the swing frame 30 for controlling the position of the swing frame relative to the tractor in the well-known manner.

Figure 2:
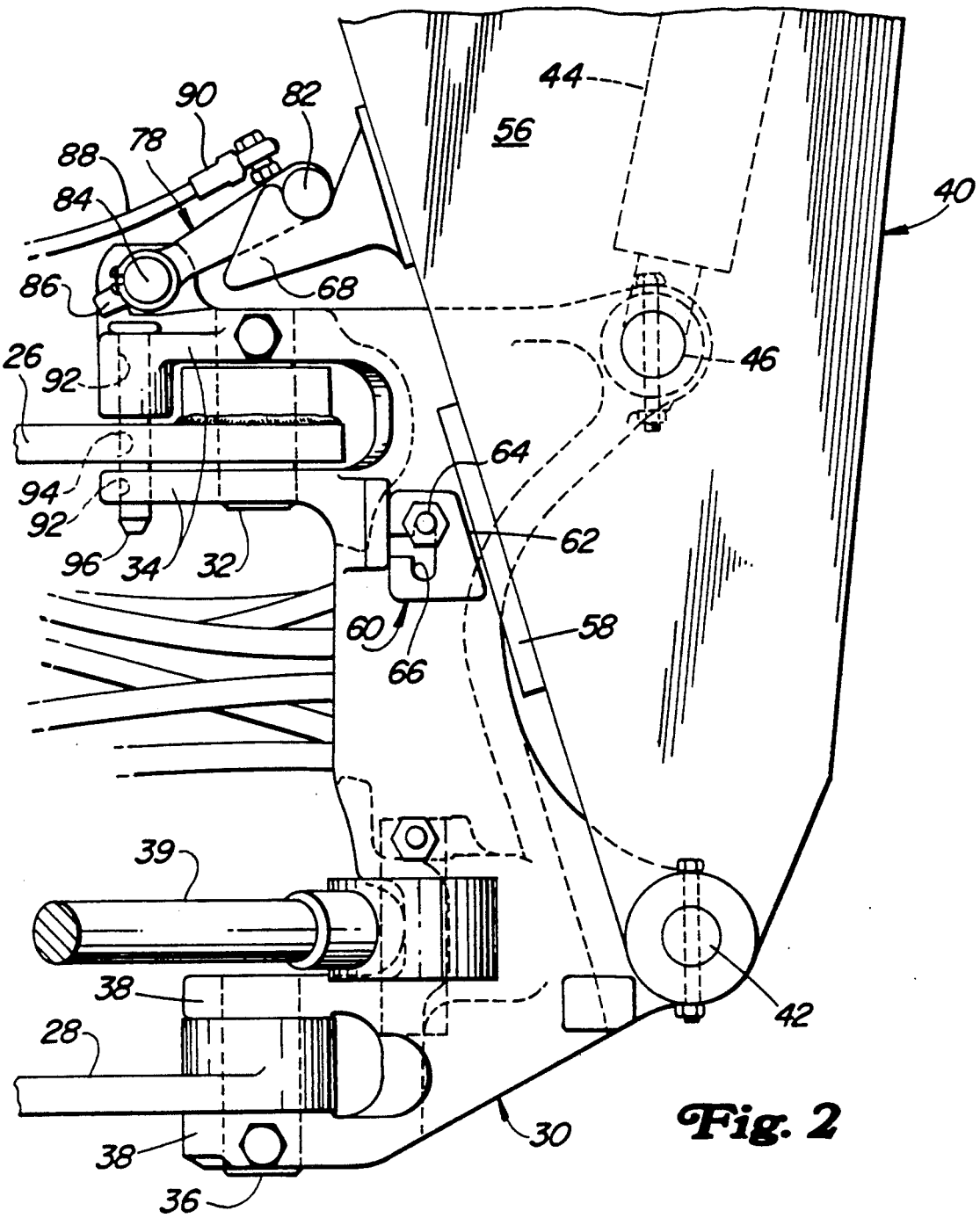
FIG. 2 is a side elevation view of the backhoe swing frame and lower end of the backhoe boom and showing the improved boom lock mechanism.

A backhoe boom, indicated in its entirety by the numeral 40, has its lower end pivotally connected to the lower rearward end of the swing frame 30 by means of a transverse pivot 42, and the boom is swingable on the pivot 42 between a generally upright transport position, as shown in FIG. 2, and a more rearwardly extending operating position, as shown in FIG. 1. The position of the boom relative to the swing frame is controlled by a boom cylinder 44 that has its lower or piston end mounted to the upper rearward end of the swing frame by a transverse pivot 46 that is parallel to and above the pivot 42, the upper end of the cylinder 44 being disposed within the boom and connected thereto in the known manner. A dipper stick 48 is pivotally connected to the upper end of the boom, and its position is controlled by a hydraulic cylinder 50 operative between the boom 40 and the rearward end of the dipper stick, while a bucket 52 is pivotally connected to the end of the dipper stick and its position is controlled by a bucket cylinder 54 operative between the bucket and the dipper stick. All of the above represented more or less known backhoe construction.

The boom is formed by a beam having parallel, generally triangularly side panels 56. A pair of wear strips 58 are attached to the rear sides of the respective side panels a short distance above the lower pivot 42. An adjustable boom stop, indicated generally by the numeral 60, is mounted on the side of the swing frame 30 and has an inclined rear surface 62 that is parallel with and engages the right wear strip 68 when the boom is swung rearwardly past its transport position shown in FIG. 2. The stop is connected to the swing frame by a bolt 64 that extends through a vertical slot 66 in the stop, and, as is apparent, the position of the rear surface 62 relative to the boom can be adjusted by loosening the bolt 64 and moving the stop 60 vertically to the desired position, and then reclamping the stop to the swing frame by tightening the bolt 64. Such adjustment is desirable to compensate for wear on the various components, since it is desirable that the movement of the boom forwardly past the vertical transport position shown in FIG. 2 is limited.

A pair of lock members 68 respectively extend forwardly from the boom side panels 56 above the wear strips 58, and since the lock members are identical, only the right-hand member, which is shown in FIGS. 2–4, will be described in detail. The lock member is formed by a generally upright plate having an upwardly open socket 70. The socket has an arcuate bottom with a generally upright front surface 72, that is approximately parallel to the leading edge of the lower portion of the boom, and an inclined rear surface 74 that intersects the front edge of the boom. An upwardly and rearwardly inclined ramp 76 is located on the front side of the lock member 68, the rearward end of the ramp 76 being located at the top of the front surface 72 of the socket.

A T-shaped latch member 78 has a bifurcated generally fore and aft base or stem portion 80. The cross portion of the T is formed by a pair of cylindrical pins 82 that extend outwardly from the rear end of the base 80, the front end of the base 80 being pivotally connected to the upper end of the swing frame by a transverse pivot 84 that extends through a boss extending upwardly from the top arm 34 of the swing frame. Thus, the latch member 78 is swingable in a vertical arc about the pivot 84, which is parallel to the boom pivot 42. A tab 86 extends rearwardly from the base 80 of the latch member and is engageable with the swing frame to prevent the latch member from flipping over past a vertical position.

A cable 88 has its rearward end connected to the latch member rearwardly of the pivot 84 by a connection 90 that includes a ball and socket connection, whereby forward pulling of the cable 88 causes the latch member 78 to swing upwardly and rearwardly about the pivot 84. The forward end of the cable 88 is connected to a suitable control lever at the operator station 16 so that the latch member can be remotely positioned by the operator from the operator station.

The upper arms 34 of the swing frame are provided with vertically aligned bores 92 that align with a vertical bore 94 in the upper frame member 26 when the swing frame is in a straight fore and aft position, as shown in FIG. 3. A pin 96 is insertable downwardly through the bores 92 and 94 to releasably lock the swing frame 30 to the tractor main frame in its centered position, thereby preventing the swing frame from shifting from side to side while the pin is in place during transport of the machine.

In operation, the latch member 78 is normally positioned in its lowermost position as shown in FIG. 4, wherein the lock members 68 will ride over the top of the pins 82 when the boom is swung to its upright position. Thus, the operator need not be concerned with the boom automatically locking if it is moved to its full upright position against the stop 60. However, if the operator wishes to lock the boom, such as when the machine is being transported or when the backhoe is functioning as a crane, the operator pulls on the cable 88 to raise the latch member 78 to the position shown in dotted lines in FIG. 4. In that position, as the boom is moved toward its upright, transport position, the ramps 76 on the lock members 68 will engage the pins 82 on the latch member, forcing the latch member upwardly and rearwardly about the pivot 84 until the pins clear the ramps 76, at which time, the pins 82 will drop into the sockets 70. After the latch member pins seat in the sockets, when the controlling force exerted by the boom cylinder 44 is released, the weight of the boom would tend to pivot the boom rearwardly, so that the pins would engage the front surfaces 72 of the sockets. The force of engagement is such that the latch member is held in place, and the latch member cannot be moved to a position wherein it releases the lock members by inadvertent pulling on the cable 88. To release the boom lock, the operator pressurizes the cylinder 44 to swing the boom rearwardly against the stop 60, at which time the cable can be pulled to swing the latch member 78 upwardly and forwardly so that the pins clear the sockets 70. The boom can then be moved rearwardly, and the latch member can be shifted downwardly to its inoperative position as shown in FIG. 4.

Figure 5:
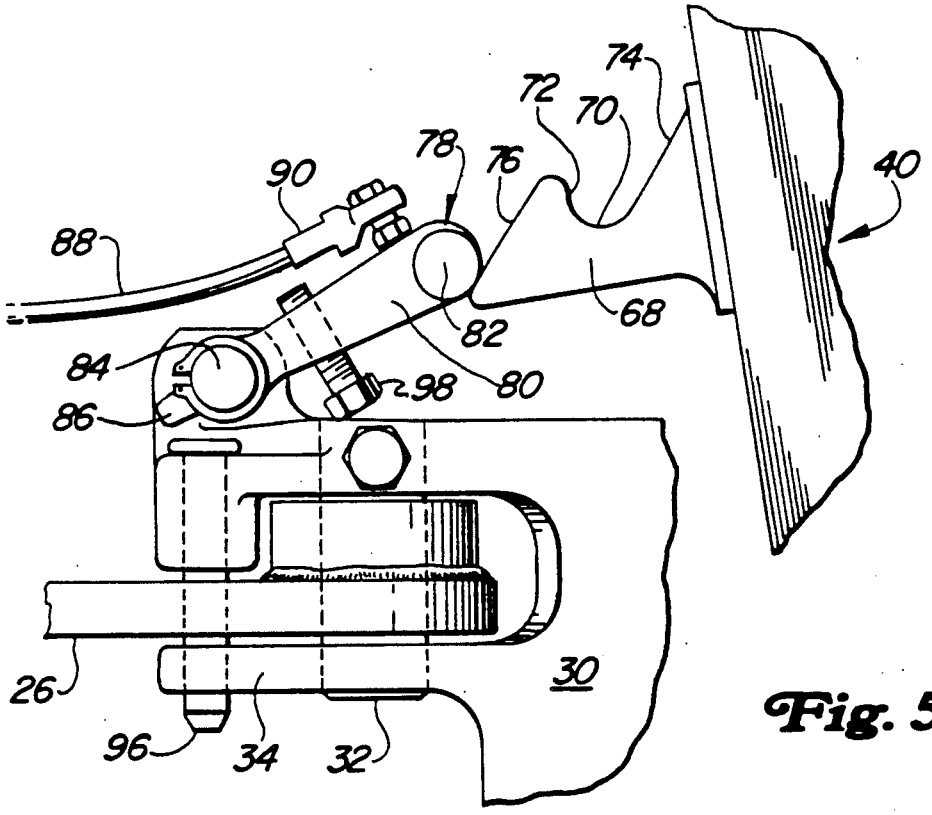
FIG. 5 is a view similar to FIG. 4 showing an alternate embodiment of the invention having a device that selectively positions the latch element for automatic locking of the boom as it shifts to its transport position.

An alternate embodiment is shown in FIG. 5 wherein a stop bolt 98 is threaded upwardly into the base of the latch member 78. When the bolt 98 is threaded into the member 98 as shown in FIG. 5, it maintains the latch member 78 in an elevated position wherein the pins 82 will engage the ramps 76 of the lock members automatically as the boom moves rearwardly to its transport position. Thus, the latch member can be located so that it automatically locks the boom whenever the boom is moved to its forwardmost transport position. As is apparent, if the operator at his option does not desire the automatic latching feature, the stop bolt 98 can simply be unscrewed to permit the latch member to swing downwardly to its lowermost position wherein it clears the lock members as the boom moves forwardly.

I claim:

1. In a vehicle mounted backhoe having a swing frame pivotally mounted on the vehicle, a boom swingably mounted on the swing frame on a horizontal pivot for movement between a generally vertical transport position and selected working positions, and a hydraulic cylinder operative between the boom and the swing frame for positioning the boom, an improved locking device for selectively locking the boom to the swing frame in the transport position comprising:

a horizontal latch pivot mounted on the swing frame parallel to the boom pivot;

a latch member swingably mounted on the latch pivot for shifting between first and second positions and including horizontal pin means generally parallel to the latch pivot; and a lock member mounted on the boom and including upwardly open socket means adapted to receive and hold the pin means when the boom is in its transport position and the latch member is in its first position to lock the boom to the swing frame, the pin means clearing the socket in its second position;

cam means on the lock member adjacent to the socket means and operatively engageable with the pin means to shift the latch member into its second position as the boom is shifted from a working position into its transport position, the pin means clearing the cam means when the boom reaches its transport position so that the pin means is free to drop into the socket means;

control means operatively connected to the latch member for shifting it from its first to its second position;

a stop member mounted on the swing frame and engageable with the boom to limit the movement of the boom beyond its transport position as the boom shifts from a working position into its transport position; and means for adjusting the position of the stop member on the swing frame.

2. The invention defined in claim 1 wherein the latch member is T shaped and has its base pivotally connected to the latch pivot, the horizontal pin means including a pair of horizontal pins that extend from opposite sides of the base of the latch member, the lock member including a pair of laterally spaced lock elements extending from the boom and respectively forming a pair of sockets respectively adapted to receive the horizontal pins, the cam means comprising a pair of ramps respectively disposed on the lock elements and engageable with the respective pins.

3. The invention defined in claim 1 wherein the latch member is shiftable into a third position below its first position, the lock member being disposed above and out of engagement with the latch member when the boom is in its transport position and the latch member is in its third position.

4. The invention defined in claim 3 and including a selectively positionable stop means operative between the latch member and the swing frame for selectively preventing the movement of the latch member into its third position.

5. The invention defined in claim 4 where the socket means includes at least one upwardly open hook structure having a generally vertical surface that engages the pin means, the weight of the boom causing the vertical surface to exert a force on the pin means that maintains the latch member in its first position, the latch member being shiftable from its first position to its second position by the control means only when the boom is moved to shift the weight of the weight of the boom off of the pin means.

6. The invention defined in claim 1 where the socket means includes at least one upwardly open hook structure having a generally vertical surface that engages the pin means, the weight of the boom causing the vertical surface to exert a force on the pin means that maintains the latch member in its first position, the latch member being shiftable from its first position to its second position by the control means only when the boom is moved to shift the weight of the boom off of the pin means.

7. The invention defined in claim 6 wherein the latch member is T shaped and has its base pivotally connected to the latch pivot, the horizontal pin means including a pair of horizontal pins that extend from opposite sides of the base of the latch member, the lock member including a pair of laterally spaced lock elements extending from the boom and respectively forming a pair of sockets respectively adapted to receive the horizontal pins, the cam means comprising a pair of ramps respectively disposed on the lock elements and engageable with the respective pins.

8. The invention defined in claim 7 wherein the latch member is shiftable into a third position below its first position, the lock member being disposed above and out of engagement with the latch member when the boom is in its transport position and the latch member is in its third position.

* * * * *